US008039720B2

(12) United States Patent
Stein

(10) Patent No.: US 8,039,720 B2
(45) Date of Patent: Oct. 18, 2011

(54) STRINGED INSTRUMENT HAVING COMPONENTS MADE FROM GLASS AND METHODS OF MANUFACTURING AND ASSEMBLING THE SAME

(76) Inventor: Richard A. Stein, New Haven, IN (US)

( * ) Notice: Subject to any disclaimer, the term of this patent is extended or adjusted under 35 U.S.C. 154(b) by 0 days.

(21) Appl. No.: 12/624,471

(22) Filed: Nov. 24, 2009

(65) Prior Publication Data

US 2010/0064878 A1 Mar. 18, 2010

Related U.S. Application Data

(63) Continuation of application No. 12/496,351, filed on Jul. 1, 2009, now Pat. No. 7,767,890.

(60) Provisional application No. 61/079,153, filed on Jul. 9, 2008.

(51) Int. Cl.
*G10D 1/08* (2006.01)

(52) U.S. Cl. ..... 84/267

(58) Field of Classification Search ..... 84/267, 84/264, 293, 314 N, 84, 294, 314 R
See application file for complete search history.

(56) References Cited

U.S. PATENT DOCUMENTS

| | | | | |
|---|---|---|---|---|
| 5,696,337 | A | 12/1997 | Hall | |
| 7,368,646 | B2 | 5/2008 | Payung | |
| 7,767,890 | B2 * | 8/2010 | Stein | 84/267 |
| 2006/0174744 | A1 | 8/2006 | Payung | |

OTHER PUBLICATIONS

Web article—"Glass guitar is now invention of note", Scott Williams of the Journal Sentinel, Aug. 13, 2007 http://www.jsonline.com/news/waukesha/29311709.html.

* cited by examiner

*Primary Examiner* — Kimberly R Lockett
(74) *Attorney, Agent, or Firm* — Baker & Daniels LLP

(57) ABSTRACT

A stringed instrument, such as a guitar, having components made from glass, and methods of manufacturing and assembling the same are provided. In one exemplary embodiment, the present invention provides for manufacturing a glass fretboard, manufacturing glass frets, assembling the glass frets to the fretboard, and assembling the fretboard to the neck of the stringed instrument. In addition to the fretboard and frets, other components of the stringed instrument may also be made from glass. For example, the present invention further provides a method for manufacturing glass saddles and top nuts to allow the strings of the stringed instrument to substantially entirely contact glass. This produces a clean, crisp sound and overcomes the problem of generating an inferior sound that results from the imperfections found in natural wood components, for example.

6 Claims, 9 Drawing Sheets

STRINGED INSTRUMENT HAVING COMPONENTS MADE FROM GLASS AND METHODS OF MANUFACTURING AND ASSEMBLING THE SAME

CROSS-REFERENCE TO RELATED APPLICATIONS

This application is a continuation of U.S. application Ser. No. 12/496,351, filed Jul. 1, 2009, entitled A STRINGED INSTRUMENT HAVING COMPONENTS MADE FROM GLASS AND METHODS OF MANUFACTURING AND ASSEMBLING THE SAME, which claims the benefit under Title 35 U.S.C. §119(e) of U.S. Provisional Patent Application Ser. No. 61/079,153, entitled METHODS FOR MANUFACTURING AND ASSEMBLING GUITAR COMPONENTS MADE FROM GLASS, filed on Jul. 9, 2008, the entire disclosures of which are expressly incorporated by reference herein.

BACKGROUND

1. Field of the Invention

The present invention relates to stringed instruments having components made from glass and methods of manufacturing and assembling the same.

2. Description of the Related Art

Stringed instruments, such as guitars, typically include a neck and/or a fretboard against which a musician may hold a string of the instrument to change the musical note produced by the vibration of the string. Specifically, by plucking the string with a finger or pick or by passing a bow across a string of the stringed instrument, the string is vibrated. By depressing the string against the neck and/or fretboard of the stringed instrument at different positions therealong, the musical note that is produced by the vibrating string may be modified. This allows a musician to create a variety of musical notes utilizing a single stringed instrument.

Typically, the neck and/or fretboard of a stringed instrument is manufactured from wood, which produces an acceptable sound. However, natural imperfections in the wood may result in the stringed instrument producing sounds that may vary slightly from the ideal or desired sound. Attempts to overcome this problem have included manufacturing the neck and/or fretboard, as well as the other components of the guitar, from alternative materials, such as glass. However, the difficulty in manufacturing a neck and/or fretboard from alternative materials have prevented the use of such alternative materials from gaining mainstream appeal.

SUMMARY

The present invention provides a stringed instrument, such as a guitar, having components made from glass, and to methods of manufacturing and assembling the same. In one exemplary embodiment, the present invention provides for manufacturing a glass fretboard, manufacturing glass frets, assembling the glass frets to the fretboard, and assembling the fretboard to the neck of the stringed instrument. In addition to the fretboard and frets, other components of the stringed instrument may also be made from glass. For example, the present invention further provides a method for manufacturing glass saddles and top nuts to allow the strings of the stringed instrument to substantially entirely contact glass. This produces a clean, crisp sound and overcomes the problem of generating an inferior sound that results from the imperfections found in natural wood components, for example.

In one exemplary embodiment, a guitar is provided that includes a body, a neck, a head, and a plurality of strings. In one exemplary embodiment, the guitar includes a glass fretboard, including a glass base and glass frets, that is secured to the neck of the guitar. In one exemplary embodiment, the guitar also includes a top nut made from glass. In this embodiment, the strings are received at one end of the neck of the guitar within grooves formed in the top nut. In one exemplary embodiment, the guitar also includes saddle inserts made from glass. In this embodiment, the opposing ends of the strings are received within grooves formed in the glass saddle inserts. In this manner, the strings are substantially entirely supported by glass components.

In one form thereof, the present invention provides an instrument, including a fretted, stringed instrument, including a body, a head, and a neck extending between the body and the head, the neck having a neck longitudinal axis. The stringed instrument also includes a plurality of strings extending from the body to the head. The strings extend along the neck in a direction substantially parallel to the neck longitudinal axis. The stringed instrument also has a fretboard connected to the neck. The fretboard includes a glass base and a plurality of glass frets. The glass base has a base longitudinal axis and a plurality of fret grooves extending substantially perpendicular to the base longitudinal axis. The plurality of glass frets are secured within the plurality of fret grooves of the glass base.

In another form thereof, the present invention provides a method of manufacturing and assembling components made of glass to a fretted, stringed instrument, the instrument have a body, a head, and a neck extending between the body and the head, the method including the step of machining a plurality of grooves into a first portion of glass stock material having a first portion longitudinal axis. The plurality of grooves extends substantially perpendicular to the first portion longitudinal axis. The method including the step of machining a second portion of glass stock material to form a plurality of glass frets dimensioned for receipt within the plurality of grooves of the first portion of glass stock material and having a fret longitudinal axis. The method also including the step of securing the plurality of glass frets within the plurality of grooves in the first portion of glass stock material. The method further includes the step of connecting the first portion of glass stock material to the neck of the instrument.

In yet another form thereof, the present invention provides a method of manufacturing and assembling components made of glass for use on a stringed instrument, the method including the step of machining a plurality of grooves into a first portion of glass stock material having a first portion longitudinal axis. The plurality of grooves extends substantially perpendicular to the first portion longitudinal axis. The method includes the step of forming the first portion of glass stock material to have a first radius of curvature extending substantially perpendicular to the first portion longitudinal axis. The method also including the step of machining a second portion of glass stock material to form a plurality of glass frets dimensioned for receipt within the plurality of grooves of the first portion of glass stock material and having a fret longitudinal axis. The method further including the step of forming the plurality of glass frets to have a second radius of curvature extending along the fret longitudinal axis, with the second radius of curvature being at least as small as the first radius of curvature. The method also including the step of securing the plurality of glass frets within the plurality of grooves in the first portion of glass stock material to form a fretboard.

BRIEF DESCRIPTION OF THE DRAWINGS

The above-mentioned and other features and advantages of this invention, and the manner of attaining them, will become more apparent and the invention itself will be better understood by reference to the following descriptions of an embodiment of the invention taken in conjunction with the accompanying drawings, wherein.

Corresponding reference characters indicate corresponding parts throughout the several views. The exemplification set out herein illustrates a preferred embodiment of the invention, in one form, and such exemplification is not to be construed as limiting the scope of the invention in any manner.

DETAILED DESCRIPTION

Figure 1:
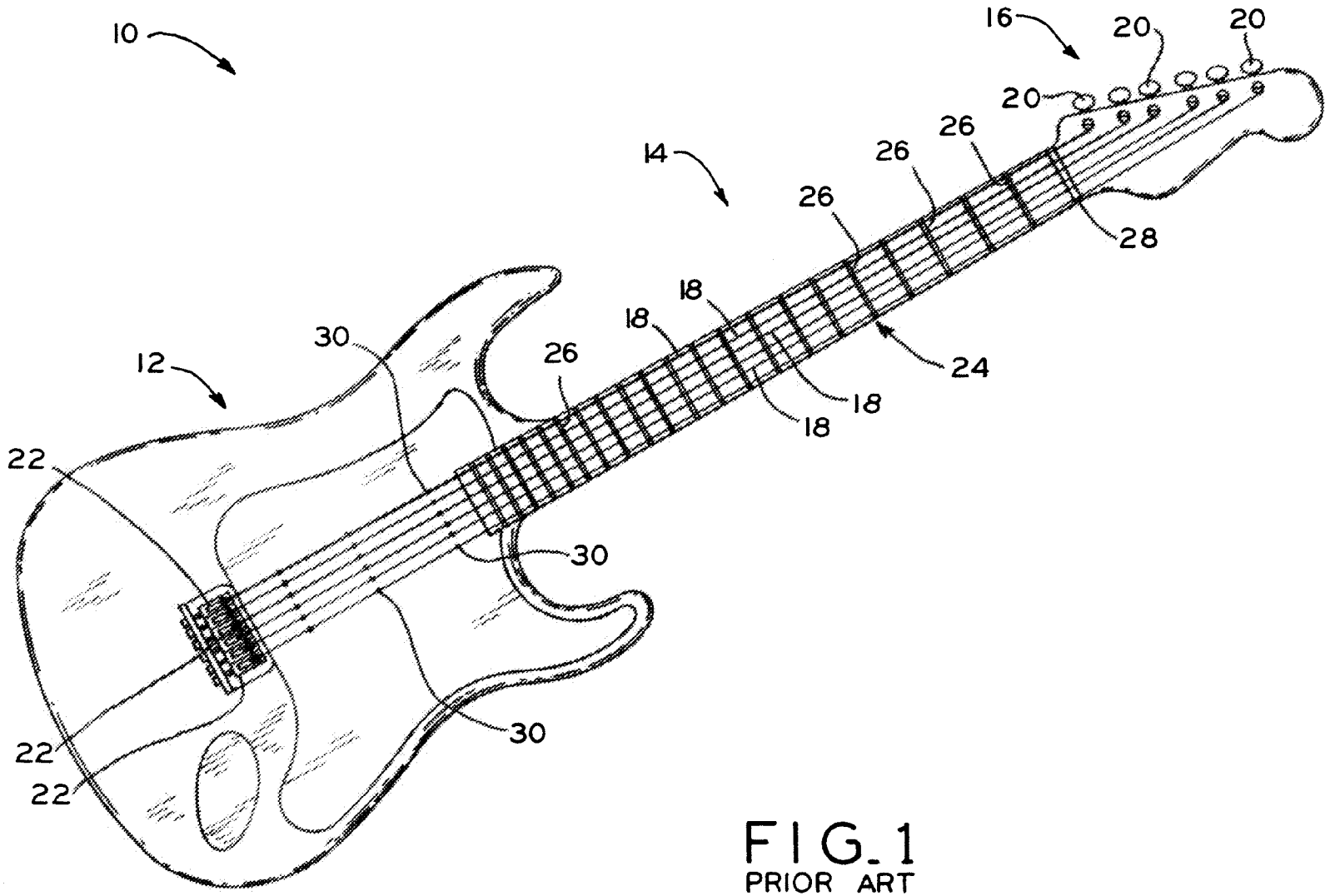
FIG. 1 PRIOR ART
FIG. 1 is a perspective view of a guitar of the prior art.

Referring to FIG. 1, guitar 10 is shown. Guitar 10 is a prior art guitar design that incorporates known guitar components. Guitar 10 includes body 12, neck 14, and head 16. Strings 18 extend from head 16 to body 12. The first ends of strings 18 are secured to machine heads or tuning pegs 20 positioned on head 16 of guitar 10. The opposing ends of strings 18 are secured within saddles 22 on body 12 of guitar 10. In this manner, strings 18 extend over neck 14 and fretboard 24. In one exemplary embodiment, strings 18 extend along neck 14 in a direction substantially parallel to the longitudinal axis of neck 14. Fretboard 24 includes frets 26, both of which are formed from wood or metal. Strings 18 may be depressed by the fingers of a musician to contact frets 26, which are strategically positioned so that the position of each of frets 26 corresponds to a different musical note. In this manner, by depressing strings 18 against different frets 26 of fretboard 24, a musician may change between different known musical notes.

Additionally, to facilitate the alignment of strings 18 across fretboard 24 and, correspondingly, the proper spacing between each of strings 18, top nut 28 is positioned above uppermost fret 26. Top nut 28 may be formed from wood or metal and includes a plurality of string grooves designed to accommodate strings 18. Further, pickups 30 are shown which allow for guitar 10 to produce an electrical signal for amplification. Alternatively, guitar 10 may be an acoustic guitar which lacks pickups 30, but may utilize additional components, such as a bridge that is substantially similar to top nut 28 that is positioned above saddles 22.

Figure 2:
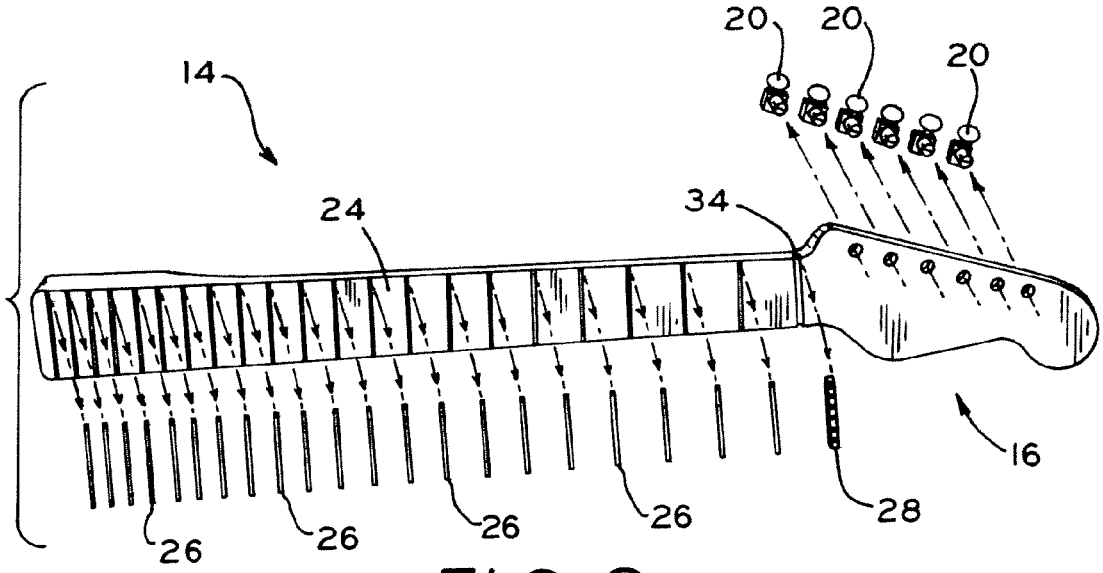
FIG. 2 is an exploded, perspective view depicting the removal of components from the guitar neck of FIG. 1.

In order to improve the sound of guitar 10, the present invention provides for manufacturing various components of guitar 10 from glass. While the present invention is described and depicted herein with specific reference to a guitar, the present invention may be used in conjunction with any fretted, stringed instrument, such as a banjo, a mandolin, a sitar, a balalaika, and a pipa. In one exemplary embodiment, in order to prepare guitar 10 for the receipt of the components manufactured from glass, the old components from guitar 10 are removed and guitar 10 is prepared for the receipt of components manufactured according to the teachings set forth herein. Referring to FIG. 2, in order to prepare guitar 10 for the receipt of new components, frets 26 and machine heads or tuning pegs 20 are removed from neck 14 and head 16, respectively. Top nut 28 is also removed from neck 14. While described and depicted herein as a method of modifying a guitar neck of a known guitar, the present method may also be used to pre-produce or manufacture original guitar necks configured for mounting a glass fretboard. In this embodiment, the need to remove the components of the guitar and other steps applicable only to the conversion of a traditional guitar to a guitar having a glass fretboard may be eliminated.

Figure 3:
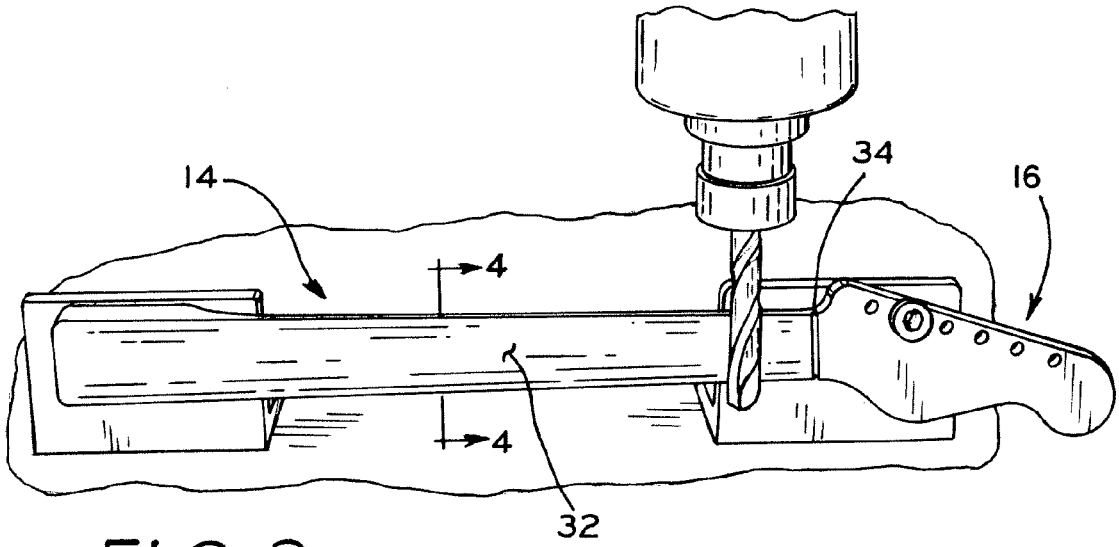
FIG. 3 is a perspective view depicting the step of machining the guitar neck of FIG. 1.
Figure 4:
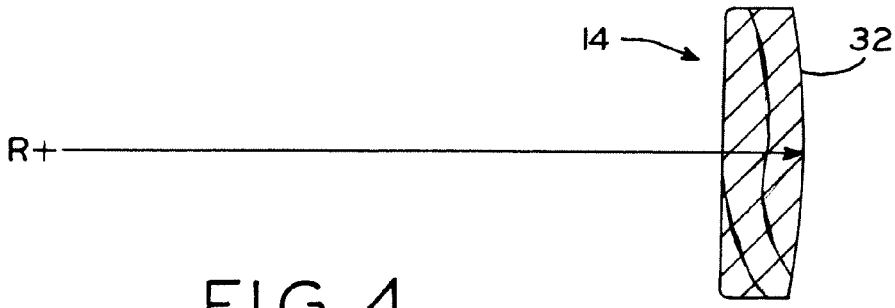
FIG. 4 is a cross-sectional view of the guitar neck of FIG. 3 taken along line 4-4 of FIG. 3.

Once the various components of guitar 10 are removed, neck 14 and head 16 may be removed from body 12. A truss rod (not shown), which places tension on neck 14 to create a desired bend or curvature in neck 14, is adjusted to straighten neck 14. Referring to FIG. 3, once straightened, neck 14 and head 16 are mounted on a milling machine, such as a computer numerical control machine ("CNC"), and the Y and Z planes of the neck set to zero. As shown in FIG. 3, stock material forming neck 14 is then milled to remove a portion of the same and to set the desired radius of curvature R (FIG. 4)

of neck 14. Referring to FIG. 4, radius of curvature R extends across neck 14 in a direction substantially perpendicular to the longitudinal axis of neck 14. In one exemplary embodiment, 0.100 inch of stock material is milled from neck 14. The removal of stock material from neck 14 provides a space for the later addition of an adhesive that is used to attach the glass fretboard to neck 14, as well as the glass fretboard itself, as described in detail below. Alternatively, as indicated above, the need to machine neck 14 may be eliminated and neck 14 may be pre-manufactured to have the desired radius of curvatures R. For example, neck 14 may be made from a polymer and may be injection molded into the desired shape.

Figure 17:
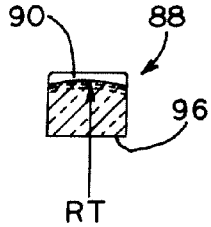
FIG. 17 is a cross-sectional view of the top nut of FIG. 16 taken along line 17-17 of FIG. 16.

Once milled as shown in FIG. 3, neck 14 is mounted with top surface 32 aligned horizontally within the milling machine. Neck 14 and head 16 are then adjusted so that top nut groove 34 is positioned square on the X and Y axes. A top nut slot is then milled into neck 14 in a direction that is substantially perpendicular to the longitudinal axis of neck 14. In one exemplary embodiment, the top nut slot has a width that is wide enough to accommodate the width of top nut 88 (FIG. 17). In one exemplary embodiment, the top nut slot is milled to a width of 0.240 inches, which is substantially equal to the width of the top nut in an exemplary embodiment. The top nut slot is also milled to a depth that yields a clearance of 0.050-0.055 inches between glass fretboard 36 (FIG. 7), the manufacture of which is described in detail below, and the bottom of strings 18. Further, any excess wood that must be removed to accommodate a proper fit of the top nut may be removed manually.

Figure 5:
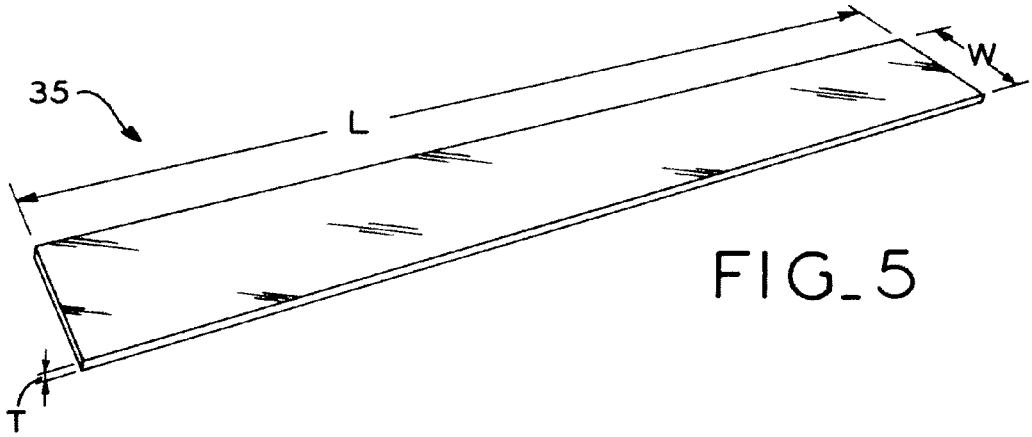
FIG. 5 is a perspective view of a glass fretboard prior to machining.

Referring to FIG. 5, in order to manufacture a glass fretboard having a glass base and a plurality of glass frets, such as glass fretboard 36, designed for assembly to neck 14, a first portion of glass stock material is cut to the desired size to form glass base 35. In one exemplary embodiment, glass base 35 has thickness T of 2.25 millimeters, width W that is at least 0.325 inches wider than the widest point on guitar neck 14, and length L that is at least 0.060 inches longer than guitar neck 14. For example, in one exemplary embodiment, width W is substantially equal to 2.5 inches and length L is substantially equal to 18.4 inches. While described and depicted herein with specific reference to preferred widths and lengths, glass base 35 of fretboard 36 may be cut to any width W and length L that is greater than the width and length, respectively, of the neck of the guitar being modified. Additionally, glass base 35 may be formed from any type of glass that is suitable for use as a base of a fretboard, such as Borofloat® 33, commercially available from Schott North America. Borofloat® is a registered trademark of Schott Jenaer Glas GmbH of Jena, Germany.

Figure 6:
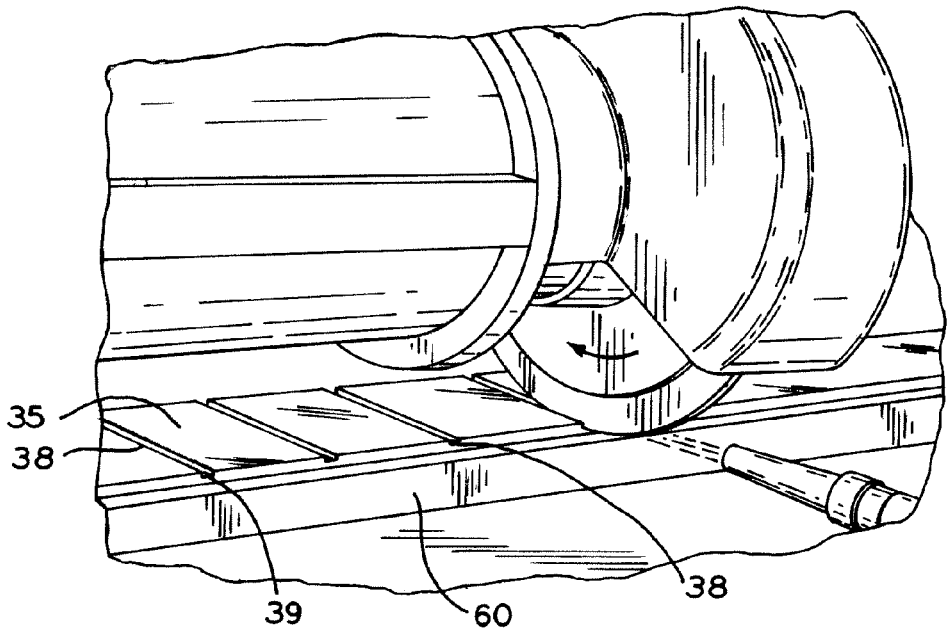
FIG. 6 is a perspective view depicting the machining of grooves into the fretboard of FIG. 5.
Figure 7:
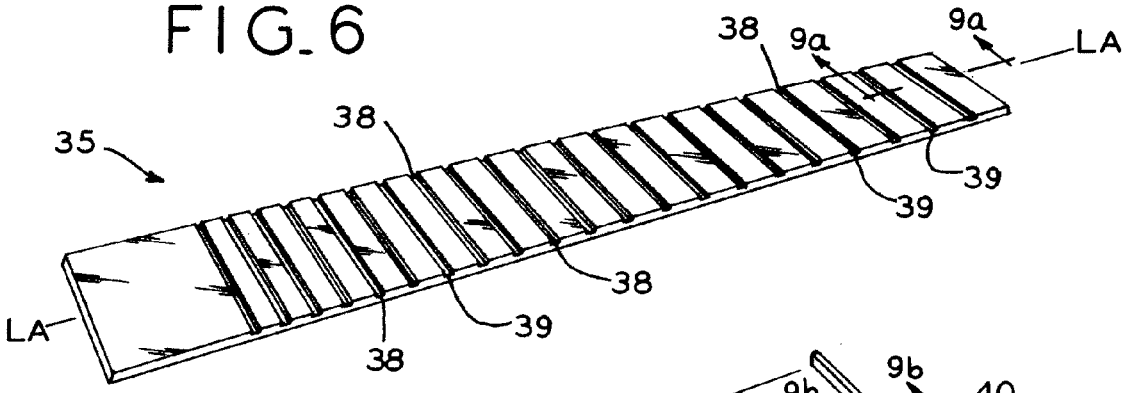
FIG. 7 is a perspective view of the glass fretboard after the machining step shown in FIG. 6.

Referring to FIG. 6, once cut or ground to the desired size, glass base 35 is then mounted on vacuum fixture 60 in a machine capable of forming grooves 38 therein. In one exemplary embodiment, glass base 35 is mounted on vacuum fixture 65 in a milling machine, such as a CNC machine, and grooves 38 are then machined therein. Grooves 38 are formed to extend across glass base 35 in a direction substantially perpendicular to longitudinal axis LA (FIG. 7) of glass base 35 and are defined at least partially by bottom walls 39. In one exemplary embodiment, each of grooves 38 is individually machined into glass base 35. In another exemplary embodiment, a gang saw may be used to cut all of grooves 38 or a portion of grooves 38 into glass base 35 in a single pass. In one exemplary embodiment, grooves 38 are cut to a size that is of 0.002 inches wider than the width of the frets being used. For example, in one exemplary embodiment, the width of the frets being used is 0.080 inches and grooves 38 are formed to 0.082 inches. Additionally, in one exemplary embodiment, grooves 38 are formed to a depth of 0.015 inches. Referring to FIG. 7, once grooves 38 have been formed in glass base 35, glass base 35 is washed and visually inspected for chips or other deformities. Once a visual inspection has been satisfactorily completed, glass base 35 has a substantially flat, planar shape, as shown in FIG. 7.

Figure 14:
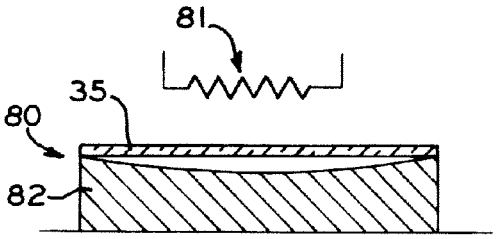
FIG. 14 is a cross-sectional view of a mold and the fretboard of FIG. 7 depicting the glass fretboard positioned within the mold.
Figure 15:
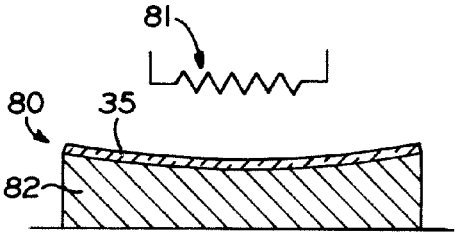
FIG. 15 is a cross-sectional view of the mold and fretboard of FIG. 14 depicting a step of molding the fretboard to a desired radius of curvature.

Referring to FIGS. 14 and 15, glass base 35 is then bent to a desired radius curvature that substantially matches the radius of curvature of neck 14. Referring to FIG. 14, mold 80 is shown having concave mold surface 82, which has a radius of curvature substantially similar to or slightly greater than the radius of curvature of neck 14. Mold 80 is heated to a temperature sufficient to cause glass base 35 to soften when positioned thereon. In one exemplary embodiment, mold 80 is heated by elements 81, such as those found in known convention ovens or gas ovens. Referring to FIG. 15, as glass base 35 begins to soften, the center portion of glass base 35 begins to sag until contacting concave mold surface 82. Once held for a period of time sufficient to allow glass base 35 to take the shape of concave mold surface 82 of mold 80, mold 80 is allowed to cool and glass base 35 is removed therefrom. Alternatively, in another embodiment, once glass base 35 has taken the shape of concave mold surface 82 of mold 80, glass base 35 is removed therefrom and allowed to cool or anneal.

Figure 13:
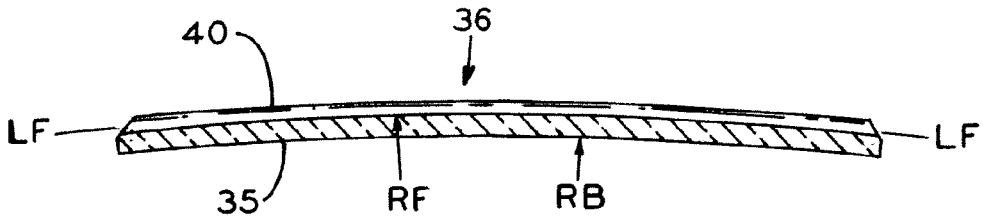
FIG. 13 is a cross-sectional view of the assembled glass fretboard of FIG. 12 taken along line 13-13 of FIG. 12.

As shown in FIG. 13, for example, once molded and cooled, glass base 35 has a radius of curvature RB substantially similar to radius of curvature R of neck 14. Further, as a result of bending glass base 35, bottom walls 39, which partially define grooves 38, also have a radius of curvature substantially similar to radius of curvature R of neck 14. Additionally, once molded, glass base 35 may be processed to impart a reverse mirror finish to mounting surface 52 (FIGS. 9 and 10) of glass base 35 and, correspondingly, fretboard 36. Alternatively, mounting surface 52 of glass base 35 may be subjected to mirror coating, chrome coating, silk screening, etching, or painting, for example. These processes may be used to apply a decorate finish or coating to mounting surface 52 of glass base 35.

Figure 8:
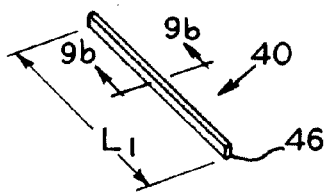
FIG. 8 is a perspective view of a glass fret.

Once glass base 35 has been bent, grooves 38 are cleaned with alcohol and/or other solvents to remove any residual oils and/or other contaminants. Once properly cleaned, glass base 35 is ready for the receipt of frets 40, which combine with glass base 35 to form fretboard 36. Referring to FIG. 8, frets 40 may be formed from any glass stock material that is suitable for use in manufacturing frets 40. In one exemplary embodiment, frets 40 are formed from a borosilicate glass rod. In one exemplary embodiment, frets 40 are formed from a glass rod having a thickness of approximately two millimeters. In one exemplary embodiment, the glass rod is cut into individual bars having lengths $L_1$ of approximately 2.750 inches to form frets 40. However, to form frets 40 the glass rod may be cut into individual bars having any length that is greater than width W of glass fretboard 36, which insures that frets 40 are of sufficient size that they can be readily handled and manipulated during manufacturing.

Once frets 40 are formed, the surfaces of frets 40 are inspected for defects or other deformities and each of the individual frets 40 are then waxed, i.e. secured, to a substrate with any defects pointed away from the substrate, i.e., exposed to the surroundings. In one exemplary embodiment, the wax is an optical wax utilized to secure opposing pieces of glass together. Thus, in this embodiment, the substrate is also a piece of glass. Once the individual frets 40 are waxed to the substrate, frets 40 are lapped and polished to a thickness of 0.052-0.055 inches. The exposed surfaces of frets 40 are then inspected and reworked as needed. Once the surface of frets 40 is deemed acceptable, the individual frets 40 are unwaxed, degreased, and washed.

Figure 14A:
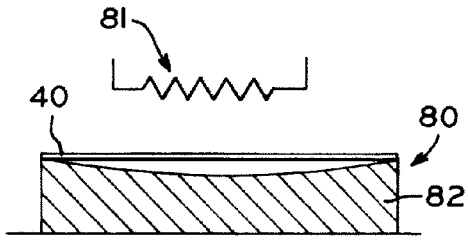
FIG. 14A is a cross-sectional view of a mold and the fret of FIG. 8 depicting the glass fret positioned within the mold.
Figure 15A:
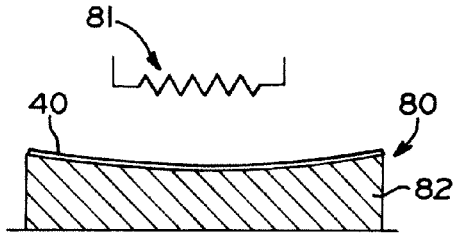
FIG. 15A is a cross-sectional view of the mold and fret of FIG. 14A depicting a step of molding the fret to a desired radius of curvature.

In one exemplary embodiment, frets 40 are then bent or sagged to have a radius of curvature RF (FIG. 13) extending in a direction along longitudinal axis LF of frets 40. In one exemplary embodiment, radius of curvature RF is substantially similar to radius of curvature R (FIG. 4) of neck 14. Specifically, frets 40 are bent or sagged in a substantially similar manner as glass base 35. Referring to FIGS. 14A and 15A, mold 80 is shown having concave mold surface 82, which has a radius of curvature substantially similar to or slightly greater than radius of curvature R of neck 14. Alternatively, in another exemplary embodiment, mold surface 82 of mold 80 may be convex. This allows for frets 40 placed thereon to bend downward to conform to the shape of mold 80. Additionally, mold 80 may include grooves, indentations, and/or projections, for example, to maintain frets 40 in a desired position during the molding process.

Once frets 40 are positioned on mold 80, mold 80 is heated to a temperature sufficient to cause frets 40 to soften when positioned thereon. In one exemplary embodiment, mold 80 is heated by elements 81, such as those found in known convection ovens. As frets 40 begin to soften, the center portion of frets 40 begin to sag until contacting concave mold surface 82. Once held for a period of time sufficient to allow glass frets 40 to take the shape of concave mold surface 82 of mold 80, mold 80 is allowed to cool and frets 40 are removed therefrom. In one exemplary embodiment, frets 40 may be molded to fret radius of curvature RF greater than radius of curvature R of neck 14. This may be necessary as a result of frets 40 having a tendency to revert to a neutral, i.e., straight, configuration. Thus, if frets 40 are not molded to fret radius of curvature RF greater than radius of curvature R of neck 14 and frets 40 revert at least partially toward a neutral position, frets 40 may break when subjected to the bending forces necessary to attach frets 40 to glass base 35 to form fretboard 36.

Flat, mounting surfaces 46 (FIG. 8) of frets 40 may then be subjected to a chrome coating process that deposits a layer of chrome on flat, mounting surface 46. Alternatively, mounting surfaces 46 of frets 40 may be subjected to mirror coating, reverse mirror coating, silk screening, etching, or painting, for example. These process may be used to apply a decorate finish or coating to mounting surfaces 46 of frets 40. The frets may then be inspected and sorted by thickness. The ends of frets 40 are then trimmed to a maximum length $L_1$ of 2.500 inch. An additional inspection may then be performed to insure that the frets 40 are of sufficient quality for use in conjunction with glass fretboard 36.

Figure 9:
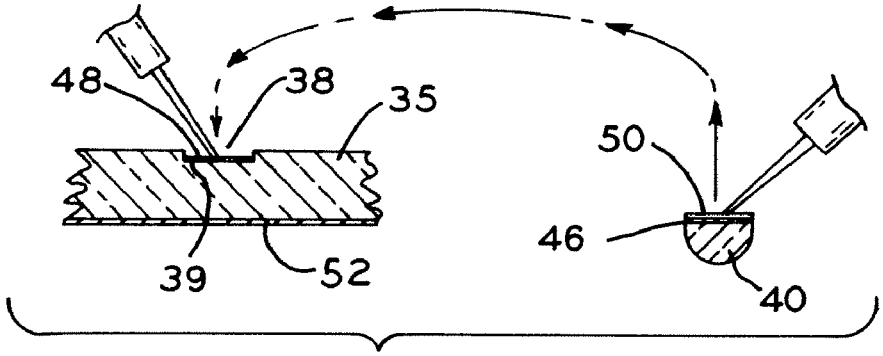
FIG. 9 is a partial, cross-sectional view of the glass fretboard and fret of FIGS. 7 and 8 taken along lines 9*a*-9*a* and 9*b*-9*b* of FIGS. 7 and 8.
Figure 10:
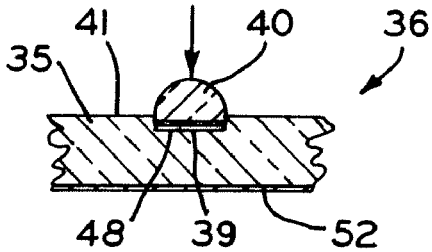
FIG. 10 is an assembled, partial, cross-sectional view of the glass fretboard and fret of FIG. 9.

Referring to FIGS. 9 and 10, glass base 35 is now prepared for the receipt of frets 40 by applying layer 48 of an adhesive to the bottom of grooves 38. In one exemplary embodiment, the adhesive is Loctite® 392™ Structural Adhesive, Fast Fixture/Magnet Bonder, commercially available from Henkel Corporation. Loctite® is a registered trademark of Henkel Corporation of Gulph Mills, Pa. Once layer 48 of an adhesive has been applied to the bottom of each of grooves 38, layer 50 of an activator may be placed on the bottom of frets 40. In one exemplary embodiment, Loctite® 7387™ Depend® Activator or Loctite® 7380™ Depend® Activator, commercially available from Henkel Corporation, may be used. Depend® is a registered trademark of Henkel Corporation of Gulph Mills, Pa. Frets 40 may then be positioned within grooves 38 and secured in place until layer 48 of adhesive has set. The unused portion of adhesive forming layer 48, i.e, the adhesive that did not come in contact with any of the activator, may then be removed. As an alternative to the adhesives set forth above, any other adhesive capable for forming a substantially permanent bond between opposing glass components, such as Loctite® E-05CL™ Hysol® Epoxy Adhesive, commercially available from Henkel Corporation, may be used. Hysol® is a registered trademark of Henkel Corporation of Gulph Mills, Pa. With frets 40 attached to glass base 35, fretboard 36 is formed.

Figure 11:
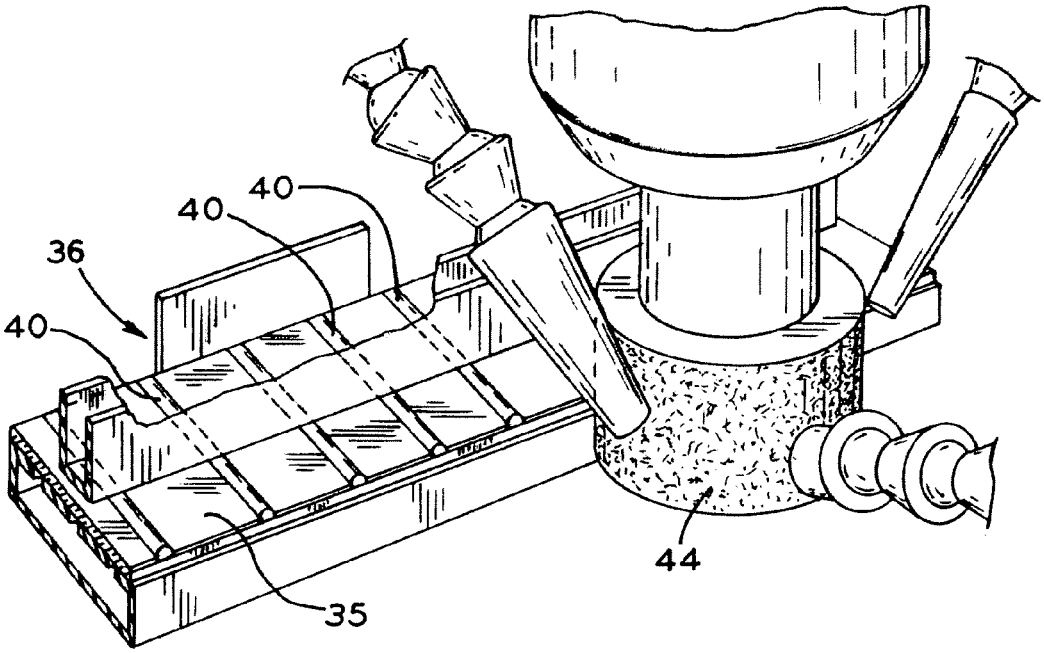
FIG. 11 is a perspective view of a step of machining the assembled glass fretboard of FIG. 10.

Referring to FIG. 11, glass fretboard 36 is mounted in a milling machine, such as a CNC machine, and a first longitudinal side of glass fretboard 36 is machined with coarse diamond grinder 44 to 0.050 inches over the desired finished width. The machine head is then changed from a coarse diamond grinder to a fine diamond grinder and the first side and chamfers of glass fretboard 36 are machined to the desired finished dimensions. The machine head is then change back to coarse diamond grinder 44 and the fretboard remounted within the milling machine for machining of a second longitudinal side as well as the corner radii. The second longitudinal side and the corner radii are ground to 0.050 inches over the desired finished dimensions. Coarse diamond grinder 44 is then changed to a fine diamond grinder. The second longitudinal side, corner radii, and end to length, as well as any additional chamfers that were not machined in conjunction with the machining of the first longitudinal side, are machined to the desired finished dimensions. Additionally, during machining of glass fretboard 36, as described in detail above, care should be taken to ensure that each of the longitudinal sides of glass fretboard 36 are machined equally to maintain the proper alignment of fretboard 36 with neck 14.

Figure 12:
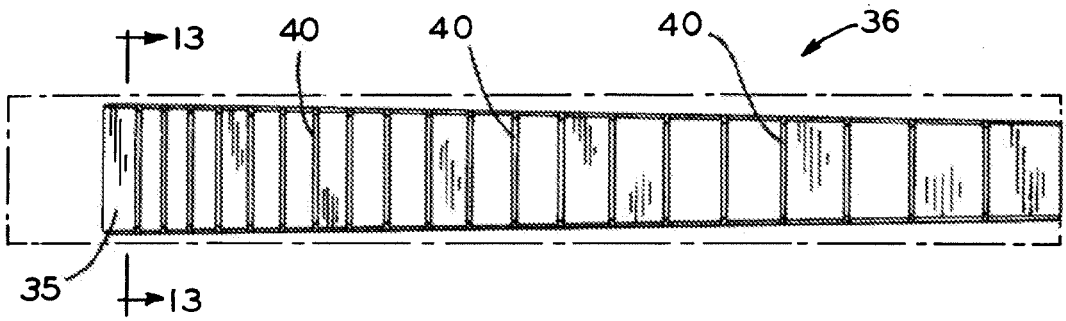
FIG. 12 is a plan view of the assembled glass fretboard of FIG. 11 after the step of machining the glass fretboard.

Any additional grinding of glass fretboard 36, such as the grinding of beveled bottom edges and/or corner radii, for example, may be performed by hand using a fine grinding wheel. Fretboard 36 is then washed, inspected, and the fret height, i.e., the height that frets 40 extend above upper surface 41 (FIG. 10) of glass base 35, measured. Fretboard 36, including glass base 35 and frets 40, are then ground and polished as necessary to remove any defects and/or to maintain the proper fret height. The resulting shape of fretboard 36 is shown in FIGS. 12 and 13. In contrast to the method described above, which requires various changes of the physical position of fretboard 36 within the milling machine, all of the machining steps may be combined into a single program using a five-axis CNC machine, for example.

Figure 18:
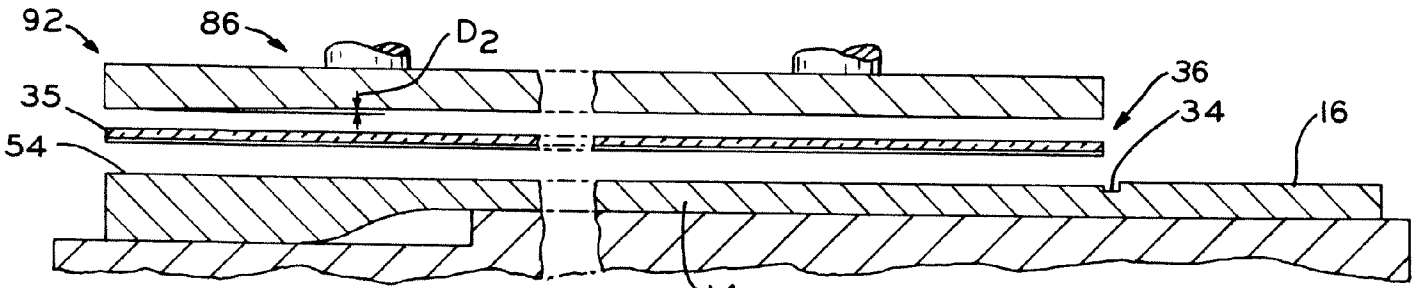
FIGS. 18-21 are partial, cross-sectional views depicting various steps of the process of assembling the fretboard and top nut to the neck of the guitar.
Figure 19:
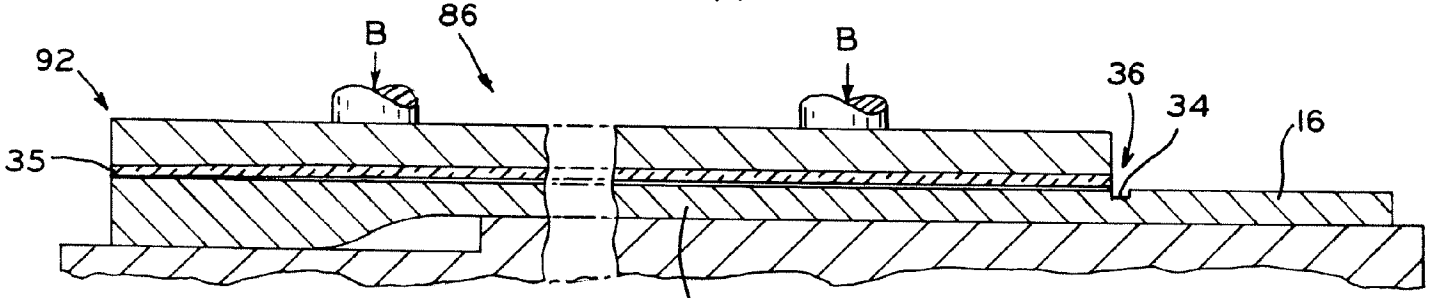

Referring to FIGS. 18-21, glass fretboard 36 is shown positioned above neck 14 of guitar 10. In order to attach glass fretboard 36 to neck 14, a layer of adhesive, such as a commercial grade 100 percent silicone glass sealer, such as those commercially available from C.R. Laurence Company, Inc., as Catalog No. 9542, is applied to surface 54 of neck 14. Glass fretboard 36 is then placed on the adhesive on surface 54 of neck 14 and pressure plate 86 is then lowered to contact glass fretboard 36. Pressure plate 86 applies pressure to glass fretboard 36, pushing the same into neck 14 in the direction of arrows B of FIG. 19. Additionally, as shown in FIG. 18, end 92 of pressure plate 86 is curved in the direction of neck 14 of guitar 10. Due to this curvature, distance $D_2$, extending between end 92 of pressure plate 86 and the longitudinal center of pressure plate 86, gradually decreases from the longitudinal center of pressure plate 86 to end 92 thereof.

Figure 20:
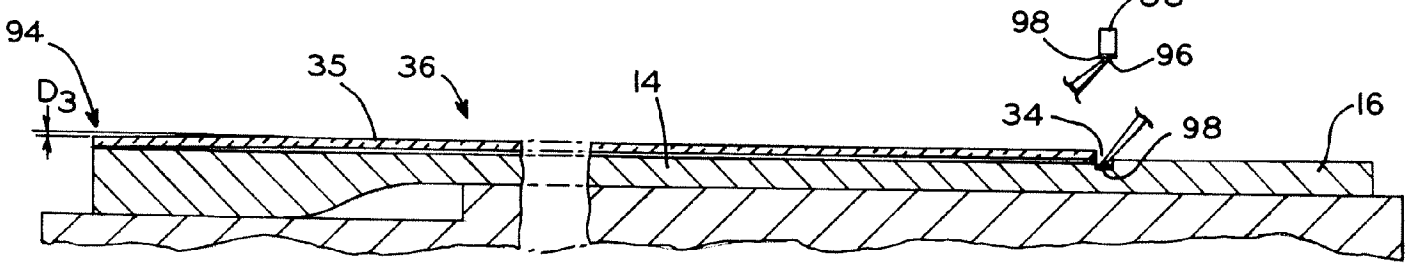
Figure 21:
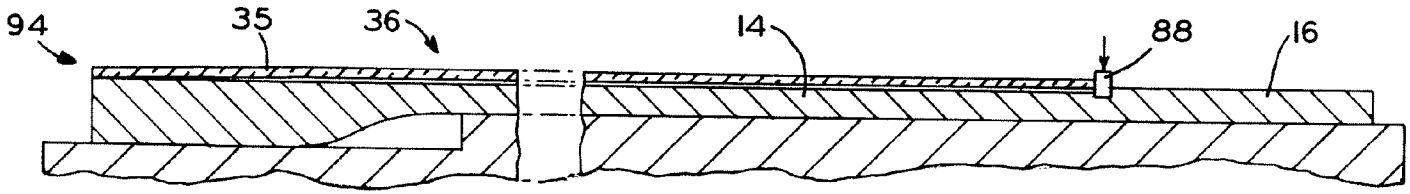

Thus, when pressure plate 86 is positioned against fretboard 36 and presses fretboard 36 into neck 14, end 94 of fretboard 36 is substantially closer to neck 14 than the longitudinal center thereof. As a result, end 94 of fretboard 36 is pressed further into the layer of adhesive on surface 54 of neck 14 than the remaining portions of fretboard 36. Referring to FIG. 20, this results in end 94 of fretboard 36 extending further into the adhesive on surface 54 by a distance $D_3$. Advantageously, this allows for strings 18 to easily pass over frets 40 at the end of fretboard 36 where frets 40 are the closest together. In one exemplary embodiment, the downward bending of end 94 of glass fretboard 36 that results from the curvature of end 92 of pressure plate 86 may be on the order of 0.005-0.006 inches. Alternatively, instead of depressing glass fretboard 36 further into the layer of adhesive on surface 54 of neck 14, a substantially similar effect may be achieved by machining neck 14 to have the desired curvature. This eliminates the need to press end 94 of glass fretboard 36 further into the adhesive on surface 54 of neck 14.

Figure 16:
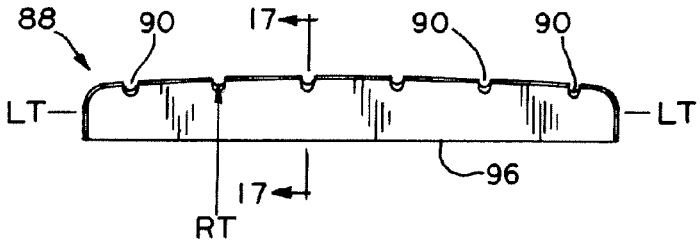
FIG. 16 is a frontal view of a top nut made in accordance with the exemplary embodiment of the present invention.

In addition to fretboard 36 and frets 40, other components of guitar 10 may also be made from glass. Referring to FIGS. 16 and 17, in one exemplary embodiment, top nut 88 may be manufactured from glass. Specifically, glass top nut 88 replaces top nut 28 of guitar 10 and is formed by grinding glass stock material, such as a fused silica or a fused quartz bar, to have a width of 1.750 inches, a height of 0.250 inches, and a length of 5.0 inches. While described and depicted herein as having exemplary dimensions, top nut 88 may be formed to any desired dimensions. Once ground, glass top nut 88 is then lapped to a height of 0.240 inches. Glass top nut 88 is then mounted in a fixture within a milling machine, such as a CNC machine, and a top radius, corner radii, and a length of 1.650 inch are ground using a fine diamond grinder. Top nut 88 is then cut to a height of at least 0.230 inches. Top nut 88 is then again mounted within the CNC machine and a flat bottom is ground on top nut 88 with a fine diamond grinder, resulting in top nut 88 having a height of 0.205 inches. Each of the edges of top nut 88 is then beveled with the fine diamond grinder and grooves are machined in the upper surface of top nut 88.

In one exemplary embodiment, shown in FIG. 16, each of grooves 90 is positioned to extend in a direction substantially perpendicular to top nut longitudinal axis LT. In one exemplary embodiment, each of grooves 90 is cut individually to have a size that is substantially similar to the size of the individual string 18 that will be positioned therein. In one exemplary embodiment, grooves 90 are machined to have a radius of curvature RT, as shown in FIG. 17. In one exemplary embodiment, grooves 90 may be formed in a single machining step with a gang saw. Alternatively, in another exemplary embodiment, grooves 90 may be formed by hand. In this embodiment, a portion of each of strings 18 is coated with diamond particles. This portion of each of strings 18 is then passed back and forth across the upper surface of top nut 88 to form a respective groove 90 therein. Once grooves 90 are formed, top nut 88 is then waxed to a substrate in a substantially similar manner as described in detail above with respect to frets 40. Top nut 88 is then lapped, polished, and inspected. Top nut 88 is then unwaxed, degreased, and washed. Next, the top radius, corner radius, bevels, and ends of top nut 88 are ground with a fine diamond film. Once the grinding is completed, top nut 88 is polished.

Top nut 88 is then washed and inspected for any defects and, if the condition of top nut 88 is deemed acceptable, flat, bottom surface 96 of top nut 88 is subjected to a chrome coating process. Once formed, top nut 88 is positioned within top nut groove 34 formed in neck 14. Specifically, referring to FIGS. 20-21, adhesive 98, such as insulating glass silicone sealant, available from C.R. Laurence Company, Inc. may be inserted within groove 34 and/or applied to surface 96 of top nut 88. Top nut 88 is then positioned within groove 34 and pressed downward toward neck 14 to create a sufficient bond between top nut 88 and neck 14.

Figure 22:
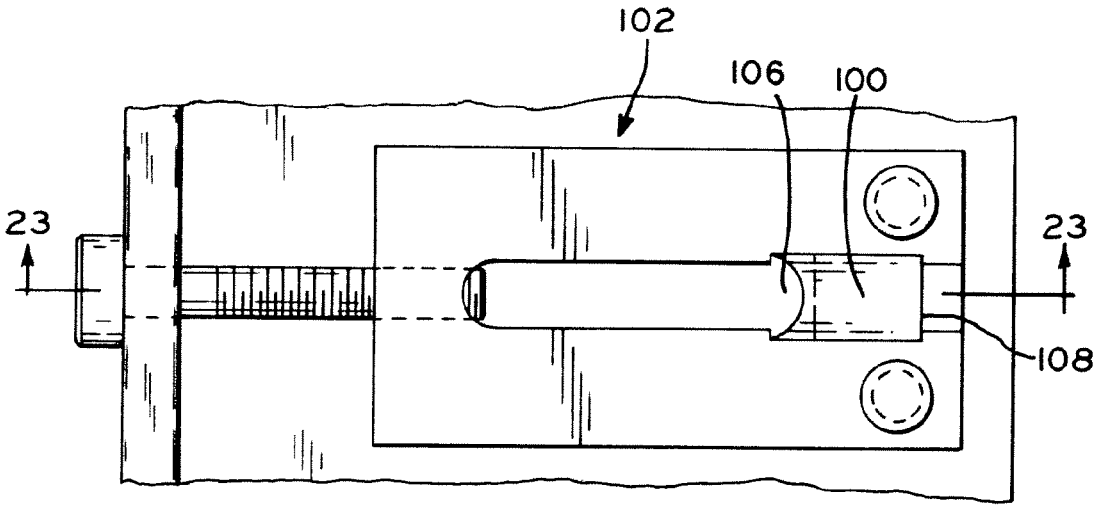
FIG. 22 is a plan view of a saddle manufactured in accordance with an exemplary embodiment of the present invention.
Figure 23:
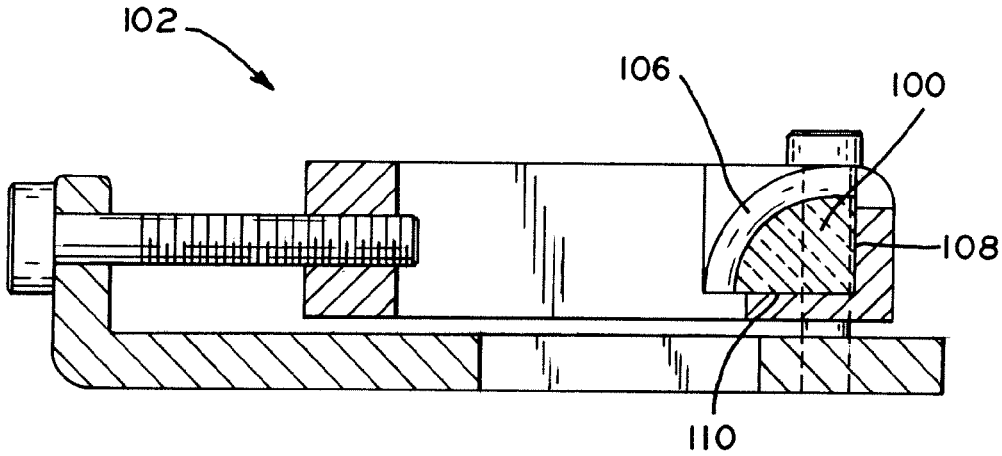
FIG. 23 is a cross-sectional view of the saddle of FIG. 22 taken along line 23-23 of FIG. 22.
Figure 24:
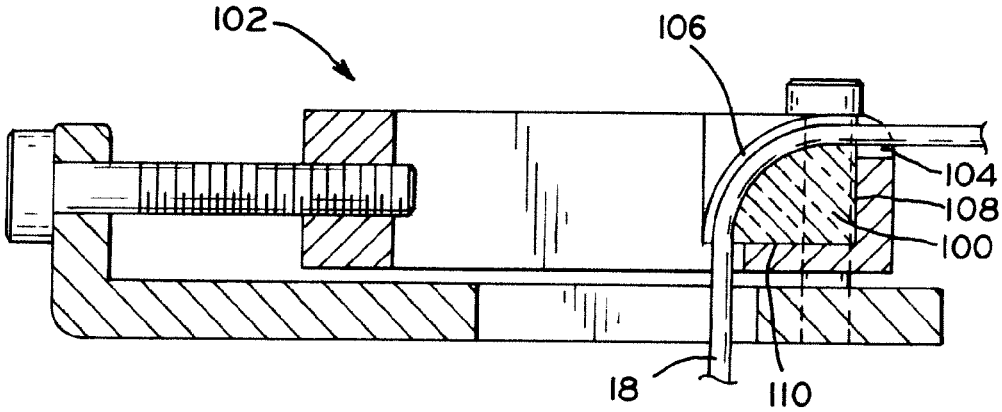
FIG. 24 is a cross-sectional view of the saddle of FIG. 22 depicting a string secured therein.

Referring to FIGS. 22-24, in addition to top nut 88, saddle inserts 100 may also be formed of glass. Saddle inserts 100 are configured for receipt within saddles 102. Saddle inserts 100 are formed from a glass stock material, such as a fused quartz or a fused silica bar, to have a width of 0.185 inches, a height of 0.220 inches, and a length of 2.000 inches. The glass stock material is waxed onto a fixture and mounted in a milling machine, such as a CNC machine. Grooves 106 having radius of 0.060 inches drawn on radius arc of 0.109 inches are machined into the bar. Grooves 106 define arcuate channels for the receipt of strings 18. As grooves 106 are formed in the bar stock, they are spaced apart by a spacing distance equal to 0.110 inches plus the width of the saw blade being used to make the cut. By forming a plurality of grooves 106 in a single piece of stock material, a plurality of saddle inserts 100 are created.

Referring to FIG. 23, in one exemplary embodiment, once formed, the bottom of grooves 106 should be 0.164 inches front surface 108 of saddle inserts 100 and 0.129 inches from bottom surface 110 of saddle inserts 100. The individual saddle inserts 100 may then be separated from the bar by sawing the bar to 0.110 inch widths. The saddle inserts 100 are then unwaxed, degreased, washed and inspected for defects. It may be necessary to hand grind individual saddle inserts 100 to insure that they fit properly within saddles 102.

Next, electric discharge machining ("EDM") is used to form rectangular pockets for saddles 102 to allow for proper clearance for strings 18. Specifically, as shown in FIG. 24, gap 104 is formed between string 18 and saddle 102. This prevents saddle 102 from contacting string 18 during vibration of the same. Alternatively, a grinding wheel may be used to form a rectangular pocket in saddles 102 and create gap 104 between saddle 102 and string 18.

Once properly formed, saddle inserts 100 and saddles 102 are cleaned with alcohol and/or other solvents to remove any residual dirt, oil, or other contaminants. Adhesives are then applied to the saddles 102 and saddle inserts 100 are positioned therein. Any excess adhesive may then be cleaned from saddles 102 and saddle inserts 100. In one exemplary embodiment, the adhesive is Loctite® 392™ Structural Adhesive Fast Fixture/Magnet Bonder. Additionally, in this embodiment, an activator, such as Loctite® 7387™ Depend® Activator or Loctite® 7380™ Depend® Activator is applied to saddle inserts 100 prior to positioning saddle inserts 100 within saddles 102. Saddles 102 may then be secured to guitar body 12 in a known manner.

Figure 25:
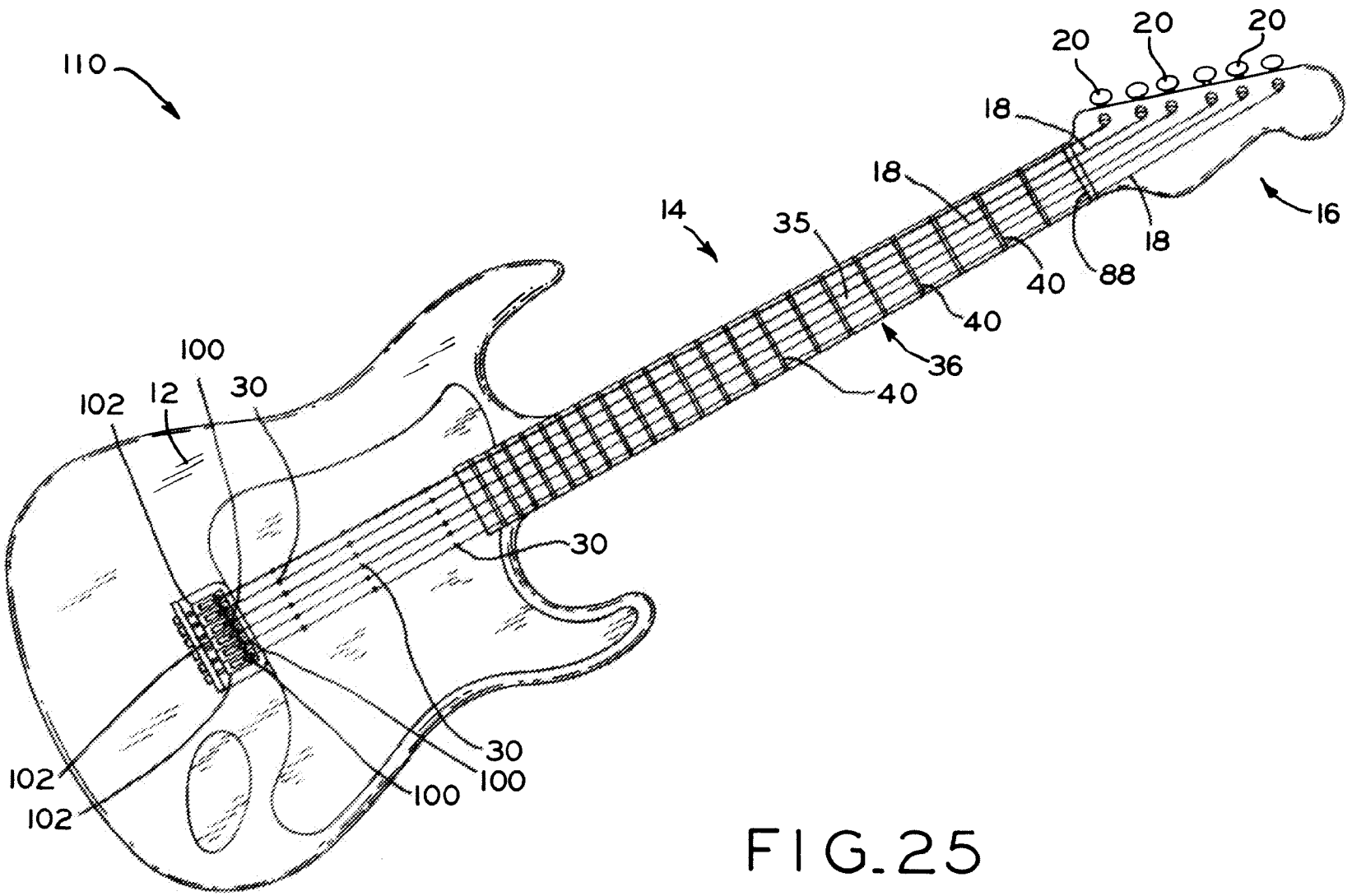
FIG. 25 is a perspective view of a guitar incorporating components of the present invention.

Referring to FIG. 25, guitar 110 is shown, which incorporates the components of the present invention. Guitar 110 includes several components that are identical or substantially identical to corresponding components of guitar 10 and like reference numerals have been used to identify corresponding parts therebetween. Referring to FIG. 25, guitar 110 includes body 12, neck 14, head 16, and strings 18. The first ends of strings 18 are secured to machine heads or tuning pegs 20 positioned on head 16 of guitar 110 in a known manner. Strings 18 are supported at one end of neck 14 near head 16 by top nut 88. As indicated above, top nut 88 is formed from glass and includes grooves 90 (FIG. 16) formed therein. Each of strings 18 are received within a respective groove 90 and supported by top nut 88. The opposing ends of strings 18 are received within grooves 106 of saddle inserts 100, which, as indicated above, are formed from glass. In this manner, strings 18 are substantially entirely supported by glass components from head 16 to body 12. Additionally, as shown in FIG. 25, strings 18 extend along neck 14 and are substantially parallel to the longitudinal axis of neck 14.

Glass fretboard 36, which is formed from glass base 35 and glass frets 40, is secured to neck 14 as described in detail above. As a result of using glass fretboard 36, even when strings 18 are depressed by the fingers of a musician, strings 18 still only contact components made of glass. Advantageously, by manufacturing the components of guitar 110 that are in substantial contact with strings 18 when guitar 110 is played from glass, a clean, crisp sound is produced by guitar 110. Further, the use of glass components eliminates imperfections that may be found in natural materials, such as wood, that cause an inferior sound to be generated by the stringed instrument.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A fretted, stringed instrument, comprising:

a body;

a head;

a neck extending between said body and said head, said neck having a neck longitudinal axis;

a plurality of strings extending from said body to said head, said plurality of strings extending along said neck in a direction substantially parallel to said neck longitudinal axis; and a fretboard connected to said neck, said fretboard including a glass base and a plurality of glass frets, said glass base having a base longitudinal axis and a plurality of fret grooves extending substantially perpendicular to said base longitudinal axis, said plurality of glass frets secured within said plurality of fret grooves of said glass base.

2. The instrument of claim 1, wherein the fretted, stringed instrument is selected from the group consisting of a guitar, a banjo, a mandolin, a sitar, a balalaika, and a pipa.

3. The instrument of claim 1, wherein said fretted, stringed instrument further comprises a saddle connected to said body and a plurality of glass saddle inserts, each of said plurality of glass saddle inserts having a string groove, said plurality of glass saddle inserts connected to said saddle, wherein each of said plurality of strings is received within one of said string grooves of said plurality of glass saddle inserts.

4. The instrument of claim 1, wherein each of said plurality of glass frets further comprise a fret longitudinal axis, each of said plurality of glass frets having a fret radius of curvature extending along said fret longitudinal axis, each of said plurality of fret grooves of said glass base being at least partially defined by a bottom wall having a bottom wall radius of curvature extending substantially perpendicular to said base longitudinal axis, said fret radius of curvature being at least as small as said bottom wall radius of curvature.

5. The instrument of claim 1, wherein said neck has a neck radius of curvature extending substantially perpendicular to said neck longitudinal axis and said glass base has a base radius of curvature extending substantially perpendicular to said base longitudinal axis, said base radius of curvature being substantially equal to said neck radius of curvature.

6. The instrument of claim 1, wherein each of said plurality of glass frets further comprise a fret longitudinal axis, each of said plurality of glass frets having a fret radius of curvature extending along said fret longitudinal axis, said fret radius of curvature being at least as small as said base radius of curvature.

* * * * *